US009452515B2

(12) United States Patent
Lee

(10) Patent No.: US 9,452,515 B2
(45) Date of Patent: Sep. 27, 2016

(54) PIVOTAL ASSEMBLY FOR HAND TOOL

(71) Applicant: Chih-Ming Lee, Taichung (TW)

(72) Inventor: Chih-Ming Lee, Taichung (TW)

( * ) Notice: Subject to any disclaimer, the term of this patent is extended or adjusted under 35 U.S.C. 154(b) by 121 days.

(21) Appl. No.: 14/616,643

(22) Filed: Feb. 6, 2015

(65) Prior Publication Data

US 2016/0229039 A1 Aug. 11, 2016

(51) Int. Cl.

*B25B 13/46* (2006.01)
*B25B 23/00* (2006.01)
*B25G 1/06* (2006.01)

(52) U.S. Cl.

CPC ..... *B25B 23/0028* (2013.01); *B25B 13/461* (2013.01); *B25B 13/463* (2013.01); *B25G 1/063* (2013.01)

(58) Field of Classification Search

CPC ..... B25B 13/463; B25B 13/461; B25B 23/0035; B25B 23/0028; B25G 1/063
USPC ..... 81/177.8, 177.9, 60–63.2
See application file for complete search history.

(56) References Cited

U.S. PATENT DOCUMENTS 4,463,632 A * 8/1984 Parke ..... B25G 1/063 403/93
5,199,335 A * 4/1993 Arnold ..... B25G 1/063 81/177.7
6,000,302 A * 12/1999 Chiang ..... B25G 1/063 81/177.7
6,131,490 A * 10/2000 Lee ..... B25B 13/461 81/177.2
6,186,030 B1 * 2/2001 Whitley ..... B25B 13/465 81/58.3
6,729,209 B1 * 5/2004 Chen ..... B25B 13/463 81/177.9
6,857,341 B1 * 2/2005 Cheng ..... B25G 1/063 81/177.7
6,957,600 B2 * 10/2005 Hu ..... B25G 1/063 81/177.7
7,841,262 B1 * 11/2010 Tsai ..... B25B 23/0028 81/177.7
2004/0177731 A1 * 9/2004 Chen ..... B25G 1/063 81/177.8
2006/0074427 A1 * 4/2006 Lieberman ..... A61B 17/1604 606/84

* cited by examiner

*Primary Examiner* — Hadi Shakeri
*Assistant Examiner* — Danny Hong

(57) ABSTRACT

A hand tool includes a body and a ratchet head which is pivotably connected to the body. A pawl and a controller are connected to the body. The ratchet head is engaged with the pawl by first and second engaging teeth. The controller has a recess which has two curved faces. The controller has two grooves and each groove has a first stop face and a second stop face. The first and second stop faces contact the two curved faces. The pawl is not moveable, and the first engaging teeth are engaged with the second engaging teeth so as to fix the ratchet head relative to the body at an angle. When the two curved faces are moved to face the two grooves, the controller is moved, and the ratchet head is pivotable relative to the body.

11 Claims, 9 Drawing Sheets

PIVOTAL ASSEMBLY FOR HAND TOOL

BACKGROUND OF THE INVENTION

1. Fields of the invention

The present invention relates to a hand tool, and more particularly, to a pivotal assembly for controlling the angle of the ratchet head relative to the handle.

2. Descriptions of Related Art

The conventional ratchet wrench such as disclosed in U.S. Pat. No. 6,131,490 comprises a ratchet head having a neck portion and a ratchet portion, a handle having an end recess receiving the neck portion, and a sleeve receiving a portion of the handle. A pivot pin fastens the ratchet head and the handle together. A first retainer ring surrounds a first end of the sleeve. The first retainer ring has an eccentric hole. An end plug plugs a second end of the sleeve. The handle has a first blind hole receiving a first spring and a first positioning ball, a second blind hole receiving a second spring and a first positioning pin, a recess hole receiving a second positioning ball, a first groove receiving a compression spring, a spherical ball, and a block, and a second groove receiving a shaft. The shaft has a positioning recess and a slant recess. The block has a bevel end and a recess aperture receiving a coiled spring and a steel ball. The positioning recess receives the spherical ball. The slant recess receives the steel ball. The bevel end engages with the slant recess. The first groove is perpendicular to the second groove. The sleeve has a slant groove, an oblong hole receiving a pressing pin, and a through aperture. The ratchet portion engages with the block. The angle of the ratchet head is adjusted. The shaft is removed. The user rotates the ratchet head until the ratchet portion engaging with the block again. Then the shaft is inserted in the second groove. The first retainer ring is rotated until reaching a loosening state. The sleeve can be moved along the handle. The first retainer ring is rotated until reaching a tightening state. The sleeve cannot be moved along the handle.

However, when the ratchet head is pivoted relative to the handle at an angle, the block and the shaft contacts each other at only one contact face, so that the ratchet head is not stable at the angled position.

The present invention intends to provide a pivotal assembly for securely pivoting the ratchet head relative to the handle to eliminate the shortcomings mentioned above.

SUMMARY OF THE INVENTION

The present invention relates to a hand tool and comprises a body having a pivotal portion which has a U-shaped recess. A first recess extends axially from the inner end of the U-shaped recess along the body and communicates with the U-shaped recess. A third recess is radially defined through the body and communicates with the first recess. A ratchet head has a pivotal end which is pivotally connected to the pivotal portion. Multiple first engaging teeth are defined in the outer surface of the pivotal end. A pawl has a tubular portion located in the first recess, and at least one second engaging tooth is formed on one end of the tubular portion and engaged with the first engaging teeth. The pawl has a fourth recess and a fifth recess defined transversely therethrough. The axis of the fourth recess is perpendicular to the axis of the fifth recess. The fifth recess defines two curved faces formed on two sidewalls of the fourth recess. A minimum distance is defined between the fourth recess and the inner end of the curved faces that is located closest to the at least one second engaging tooth. The minimum distance is larger than a distance that allows the at least one second engaging tooth to move over the first engaging teeth. A controller is a cylindrical member and located in the third recess. Two grooves are separately and defined radially in the outer surface of the controller. A portion of the body of the controller is located between the two grooves. A first stop face is defined on the outer surface of the controller and located adjacent to each of the grooves. A second stop face is defined on the outer face of the portion of the body of the controller between the two grooves. The first and second stop faces have the same radius with the curved faces. A minimum width of each of the grooves is larger or equal to the maximum width of each of the two curved faces.

When either one of the first stop faces and the second stop face are respectively in contact with the two curved faces, the at least one second engaging tooth is engaged with the first engaging teeth, and one of the two grooves is located corresponding to the fourth recess. When either one of the first stop faces and the second stop face are respectively in contact with the two curved faces, one of the first and second stop faces is located corresponding to the fourth recess. The pawl is pushed toward the groove. The at least one second engaging tooth is disengaged from the first engaging teeth.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
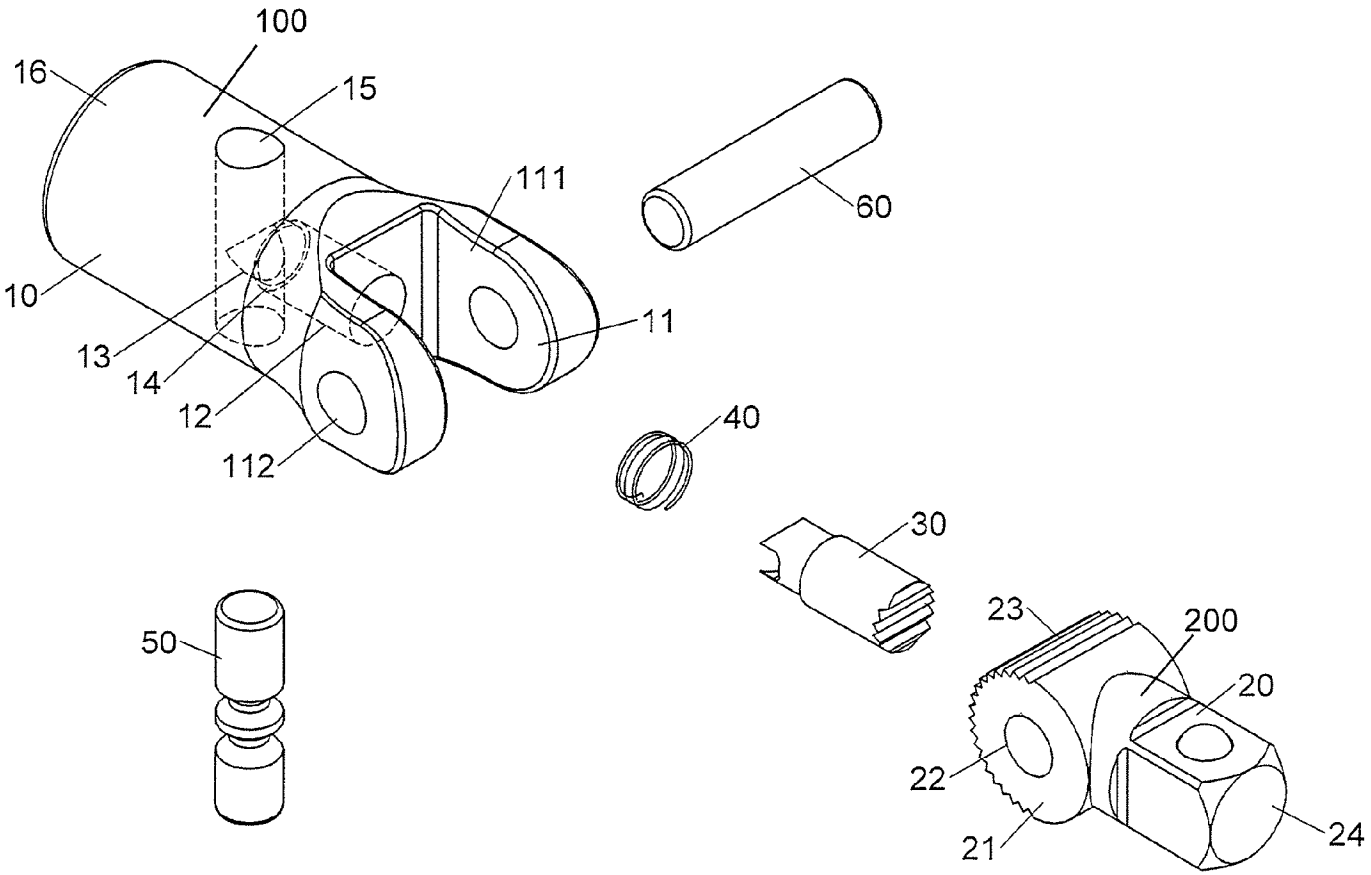
FIG. 1 is an exploded view of the hand tool of the present invention.
Figure 4:
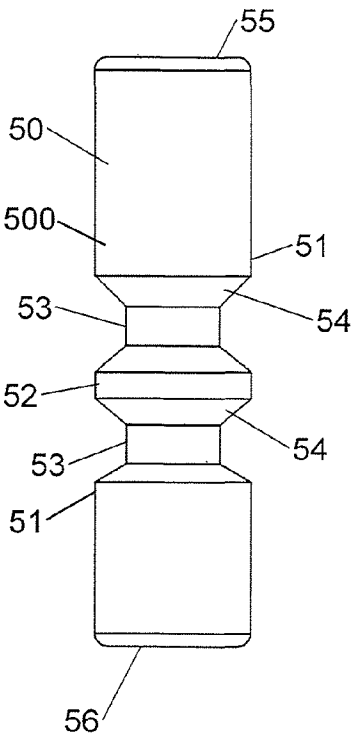
FIG. 4 is a side view of the controller of the hand tool of the present invention.
Figure 3:
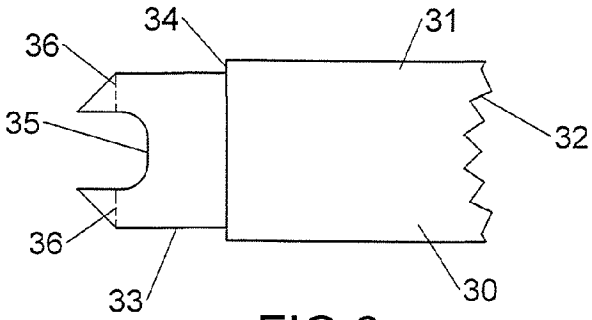
FIG. 3 is a side view of the pawl of the hand tool of the present invention.
Figure 2:
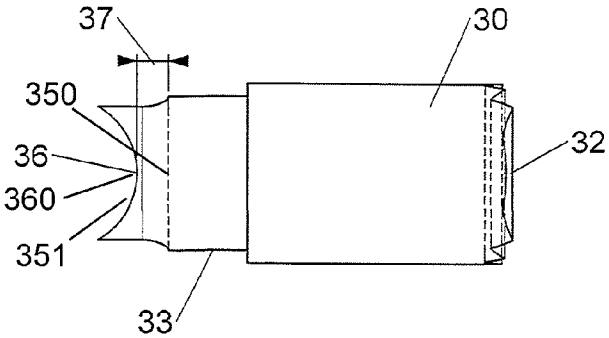
FIG. 2 is a top view of the pawl of the hand tool of the present invention.
Figure 5:
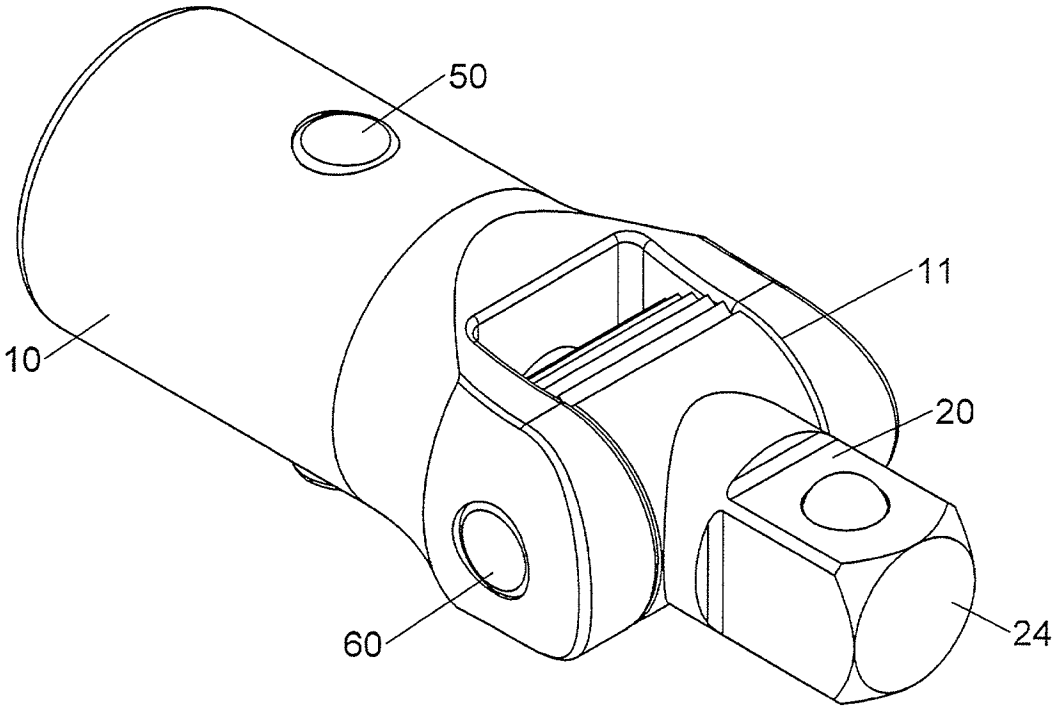
FIG. 5 is a perspective view to show the hand tool of the present invention.
Figure 6:
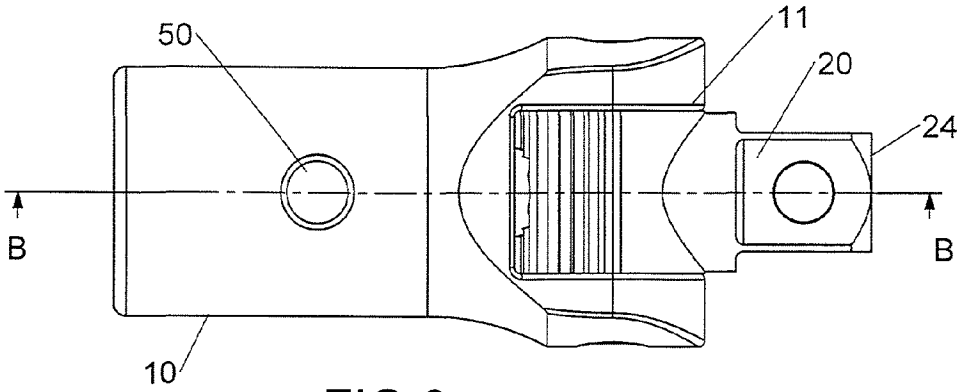
FIG. 6 is a top view to show the hand tool of the present invention.

Referring to FIGS. 1 to 8, the hand tool of the present invention comprises a body 10 having a pivotal portion 11 on one end thereof, wherein the pivotal portion 11 has a U-shaped recess 111 between two extensions. A hole 112 is defined through each of the two extensions of the pivotal portion 11. A first recess 12 extends axially from the inner end of the U-shaped recess 111 along the body 10, and communicates with the U-shaped recess. A third recess 15 is radially defined through the body 10 and communicates with the first recess 12. A second recess 13 communicates between the first and third recesses 12, 15. The radius of the second recess 13 is smaller than the radius of the first recess 12 so that a first contact face 14 is formed at the conjunction portion between the first and second recesses 12, 13. The second recess 13 communicates with a middle portion of the third recess 15 and one end of the first recess 12. The two ends of the third recess 15 open through the outer surface 16 of the body 10.

Referring to FIGS. 1 to 8, a ratchet head 20 has a pivotal end 21 which is pivotally connected to the pivotal portion 11 by extending a pin 60 through the extensions of the pivotal portion 11 and the pivotal end 21. Multiple first engaging teeth 23 are defined in a half of the outer surface of the pivotal end 21. The other end of the ratchet head 20 is an operation end 24 which is a rectangular end so as to be connected with a socket, an extension rod, an adapter or a universal connector.

Referring to FIGS. 1 to 8, a pawl 30 has a tubular portion 31 which is located in the first recess 12. At least one second engaging tooth 32 is formed on one end of the tubular portion 31 and engaged with the first engaging teeth 23. A protrusion 33 extends axially from the other end of the tubular portion 31 of the pawl 30. The radius of the protrusion 33 is smaller than the radius of the tubular portion 31 so that a second contact face 34 is formed at the conjunction portion between the protrusion 33 and the tubular portion 31. The pawl 30 has a fourth recess 35 and a fifth recess 351 defined transversely therethrough, wherein the axis of the fourth recess 35 is perpendicular to the axis of the fifth recess 351. The fifth recess 351 defines two curved faces 36 formed on two sidewalls of the fourth recess 35. A minimum distance 37 is defined between the fourth recess 35 and the curved faces 36 that is located closest to the inner end 350/360 of the at least one second engaging tooth 32. The minimum distance 37 is larger than a distance which allows the at least one second engaging tooth 32 to fully disengaged from the first engaging teeth 23.

Referring to FIGS. 1 to 8, a spring 40 is mounted to the protrusion 33, and is located in the first recess 12 and biased between the first and second contact faces 14, 34, so as to provide a force to move the pawl 30 toward the ratchet head 20.

Referring to FIGS. 1 to 8, a controller 50 is a cylindrical member and located in the third recess 15. Two grooves 53 are separately and radially defined in the outer surface 500 of the middle portion of the controller 50. Therefore, a portion of the body of the controller 50 is located between the two grooves 53. A first stop face 51 is defined on the outer surface 500 of the controller 50 and located adjacent to each of the grooves 53, and a second stop face 52 is defined on the outer face of the portion of the body of the controller 50 between the two grooves 53. The first and second stop faces 51, 52 have the same radius as the curved faces 36. The minimum width of each of the grooves 53 is larger or equal to the maximum width of each of the two curved faces 36. The grooves 53 each are defined by two tapered and outward faces 54.

Figure 7:
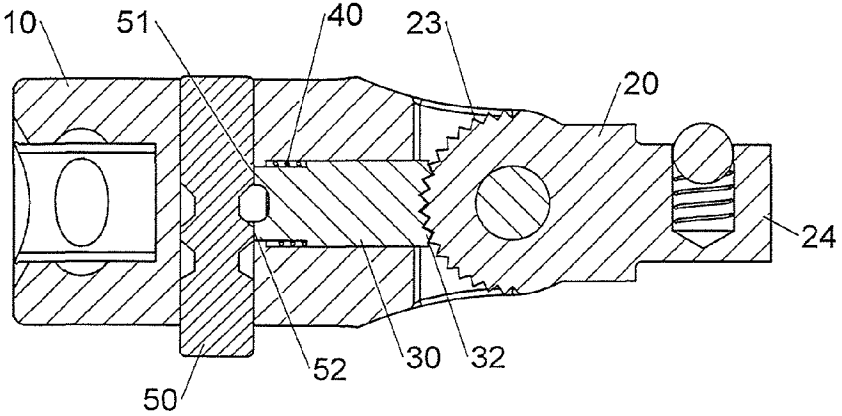
FIG. 7 is a cross sectional view, taken along line B-B in FIG. 6.
Figure 8:
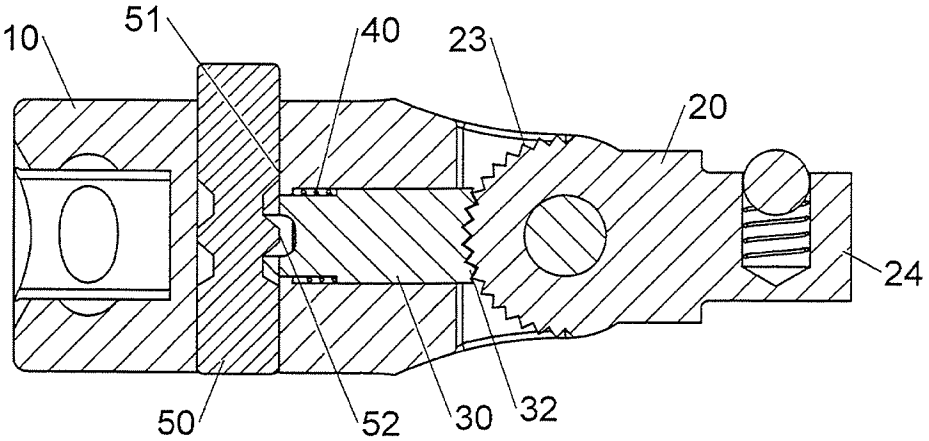
FIG. 8 is a cross sectional view to show that the first and second engaging teeth are not engaged with each other.
Figure 9:
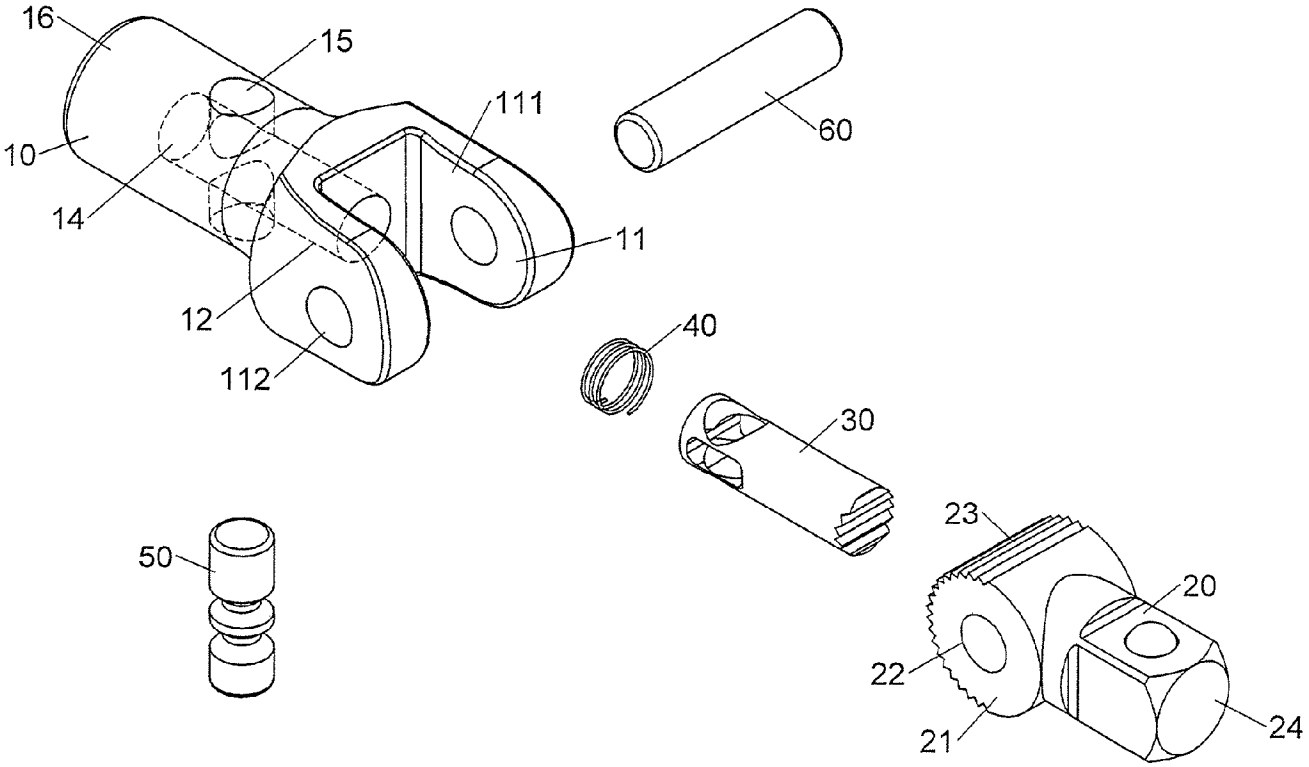
FIG. 9 is an exploded view of the second embodiment of the hand tool of the present invention.
Figure 11:
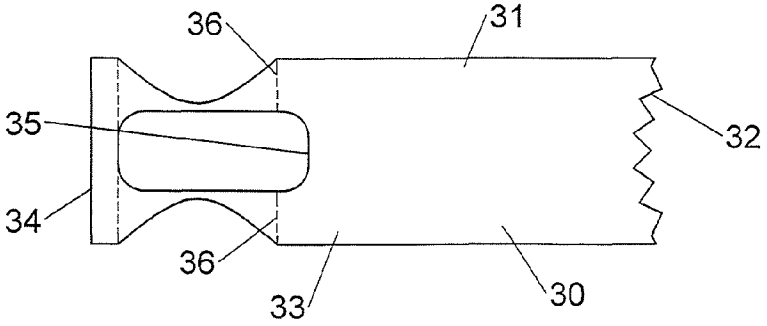
FIG. 11 is a side view of the pawl of the second embodiment of the hand tool of the present invention.
Figure 10:
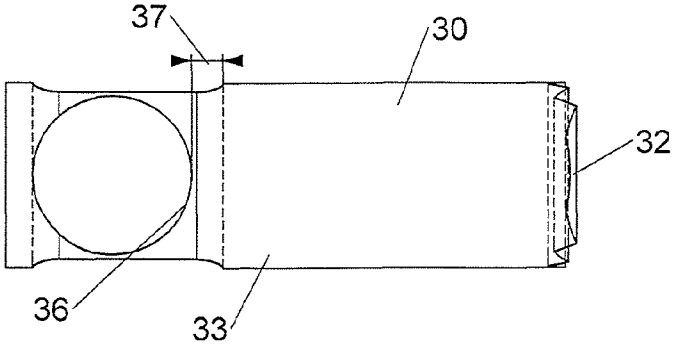
FIG. 10 is a top view of the pawl of the second embodiment of the hand tool of the present invention.
Figure 12:
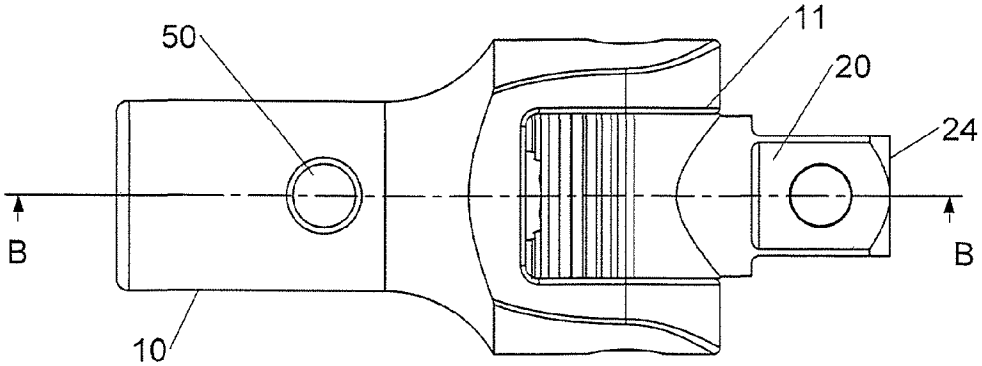
FIG. 12 is a top view of the second embodiment of the hand tool of the present invention.

Referring to FIGS. 1 to 8, when either one of the first stop faces 51 and the second stop face 52 are respectively in contact with the two curved faces 36, the at least one second engaging tooth 32 is engaged with the first engaging teeth 23, and one of the two grooves 53 is located corresponding to the fourth recess 35, By this way, the ratchet head 20 is set at an angle relative to the body 10. The controller 50 has a front end 55 and a rear end 56, both of which are designed for being pushed by the user. When the center of the front end 55 is in flush with the outer surface 16 of the body 10, as shown in FIG. 7, the rear end 56 protrudes from the outer surface 16 of the body 10. The two curved faces 36 are in contact with the first and second stop faces 51, 52. One of the two grooves 53 is located corresponding to the fourth recess 35, and the pawl 30 cannot be moved, the at least one second engaging tooth 32 is engaged with the first engaging teeth 23, so that the position of the ratchet head 20 is set relative to the body 10. As shown in FIG. 8, when the rear end 56 is pushed and the center of the rear end 56 is in flush with the outer surface 16 of the body 10, the front end 55 protrudes from the outer surface 16 of the body 10.

Referring to FIGS. 1 to 8, either one of the first stop faces 51 and the second stop face 52 are shifted away from the two curved faces 36, the second stop face 52 is located corresponding to the fourth recess 35, and the two grooves 53 are located corresponding to the two curved faces 35. Therefore, the pawl 30 is able to be moved toward the groove 53 to disengage the at least one second engaging tooth 32 from the first engaging teeth 23. The ratchet head 20 is able to be pivoted relative to the body 10.

FIGS. 9 to 13 show that the first and second recesses 12, 13 have the same radius, the first contact face 14 is located at the inner end of the first recess 12. The tubular portion 31 and the protrusion 33 have the same radius. The pawl 30 has a second contact face 34 on one end thereof. The pawl 30 has a non-circular fourth recess 35 defined transversely therethrough which is located close to the second contact face 34. The pawl 30 is located in the first recess 12. A spring 40 is received in the inner end of the first recess 12 and biased between the first and second contact faces 14, 34. The first and second stop faces 51, 52 contact the two curved faces 36.

Figure 14:
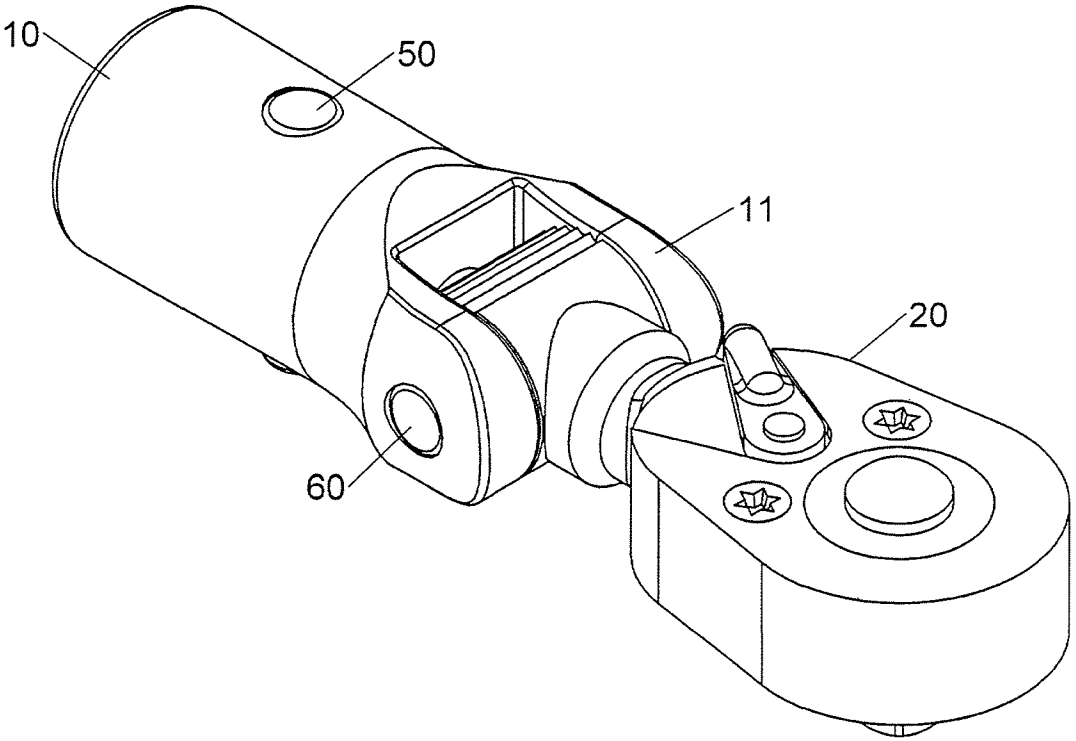
FIG. 14 is a perspective view to show the third embodiment of the hand tool of the present invention.

As shown in FIG. 1, the body 10 and the ratchet head 20 each have a handle 100, 200. As shown in FIG. 14, the operation end 24 of the ratchet head 20 is a ratchet wrench.

Figure 13:
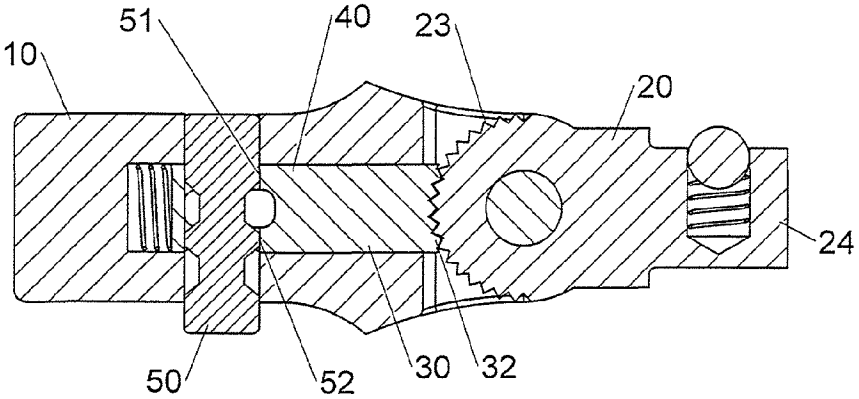
FIG. 13 is a cross sectional view, taken along line B-B in FIG. 12.

As shown in FIG. 7, the present invention needs only the pawl 30 and the controller 50 to adjust the ratchet head 20 relative to the body 10. As shown in FIGS. 7 and 13, when the ratchet head 20 is set, one of the first stop faces 51 and the second stop face 52 are in contact with the two curv41ed faces 36, the contact positions are located on two sides of the pawl 30 so that the structure is stable and the ratchet head 20 is firmly positioned. As shown in FIG. 8, when the user pushes the rear end 56, the second stop face 52 faces the fourth recess 35 so that there is a space for the pawl 30 to be moved to disengage the first and second engaging teeth 23, 32.

While we have shown and described the embodiment in accordance with the present invention, it should be clear to those skilled in the art that further embodiments may be made without departing from the scope of the present invention.

What is claimed is:

1. A hand tool comprising:

a body having a pivotal portion on one end thereof, the pivotal portion having a U-shaped recess, a hole defined through the pivotal portion, a first recess extending axially from an inner end of the U-shaped recess along the body, and communicates with the U-shaped recess, a third recess radially defined through the body and communicating with the first recess;

a ratchet head having a pivotal end which is pivotally connected to the pivotal portion by extending a pin through the pivotal portion and the pivotal end, multiple first engaging teeth defined in an outer surface of the pivotal end;

a pawl having a tubular portion which is located in the first recess, at least one second engaging tooth formed on an end of the tubular portion and engaged with the first engaging teeth, the pawl having a fourth recess and a fifth recess defined transversely therethrough, an axis of the fourth recess being perpendicular to an axis of the fifth recess, the fifth recess defining two curved faces formed on two sidewalls of the fourth recess, a minimum distance being defined between the fourth recess and the curved faces that is located closest to the inner end of the at least one second engaging tooth, the minimum distance being larger than a distance which allows the at least one second engaging tooth to disengaged from the first engaging teeth, and a controller being a cylindrical member and located in the third recess, two grooves separately and radially defined in an outer surface of the controller, a portion of a body of the controller located between the two grooves, a first stop face being defined on the outer surface of the controller and located adjacent to each of the grooves, a second stop face being defined on an outer face of the portion of the body of the controller between the two grooves, the first and second stop faces having the same radius as the curved faces, a minimum width of each of the grooves being larger or equal to a maximum width of each of the two curved faces, when either one of the first stop faces and the second stop face are respectively in contact with the two curved faces, the at least one second engaging tooth is engaged with the first engaging teeth, and one of the two grooves is located corresponding to the fourth recess, when either one of the first stop faces and the second stop face are respectively in contact with the two curved faces, one of the first and second stop faces is located corresponding to the fourth recess, the pawl 30 is pushed toward the groove, the at least one second engaging tooth is disengaged from the first engaging teeth.

2. The hand tool as claimed in claim 1, wherein the first recess has a spring received therein which is biased between the body and the pawl so as to provide a force to move the pawl toward the ratchet head.

3. The hand tool as claimed in claim 1, wherein a second recess communicates between the first and third recesses, a radius of the second recess is smaller than a radius of the first recess so that a first contact face is formed at a conjunction portion between the first and second recesses, a protrusion extends axially from the tubular portion of the pawl, a radius of the protrusion is smaller than a radius of the tubular portion, a second contact face is formed at a conjunction portion between the protrusion and the tubular portion, the protrusion is located in the second recess, a spring is located in the first recess and biased between the first and second contact faces, the spring is mounted to the protrusion.

4. The hand tool as claimed in claim 1, wherein the first engaging teeth is located on a half of the outer surface of the pivotal end.

5. The hand tool as claimed in claim 1, wherein the ratchet head has an operation end which is a rectangular end.

6. The hand tool as claimed in claim 1, wherein the ratchet head has an operation end which is a ratchet wrench.

7. The hand tool as claimed in claim 1, wherein the at least one second engaging tooth comprises multiple teeth which are arranged along a curved surface.

8. The hand tool as claimed in claim 1, wherein the fourth recess is a U-shaped recess.

9. The hand tool as claimed in claim 1, wherein the grooves each are defined by two tapered faces.

10. The hand tool as claimed in claim 1, wherein the controller has a front end and a rear end, when a center of the front end is in flush with the outer surface of the body, the rear end protrudes from the outer surface of the body, when a center of the rear end is in flush with the outer surface of the body, the front end protrudes from the outer surface of the body.

11. The hand tool as claimed in claim 1, wherein the body and the ratchet head each have a handle.

* * * * *